US006196015B1

(12) United States Patent
Pignolo

(10) Patent No.: US 6,196,015 B1
(45) Date of Patent: Mar. 6, 2001

(54) BOX FOR FEEDING OF INNER UNITS OF AIR-CONDITIONING SYSTEMS

(76) Inventor: Nicola Pignolo, Via Mentana, 94, 36100, Vicenza (IT)

( * ) Notice: Subject to any disclaimer, the term of this patent is extended or adjusted under 35 U.S.C. 154(b) by 0 days.

(21) Appl. No.: 09/463,454

(22) PCT Filed: Jul. 29, 1998

(86) PCT No.: PCT/EP98/04724

§ 371 Date: Jan. 27, 2000

§ 102(e) Date: Jan. 27, 2000

(87) PCT Pub. No.: WO99/06773

PCT Pub. Date: Feb. 11, 1999

(30) Foreign Application Priority Data

Jul. 31, 1997 (IT) ..... VI97U0049

(51) Int. Cl.[7] ..... F25D 21/14; F25D 21/00
(52) U.S. Cl. ..... 62/285; 62/272
(58) Field of Search ..... 62/285, 272, 298

(56) References Cited

U.S. PATENT DOCUMENTS 4,974,421 * 12/1990 Kim ..... 62/272
5,664,430 * 9/1997 Karman ..... 62/285

FOREIGN PATENT DOCUMENTS 9-126490 5/1997 (JP) .
9-159201 6/1997 (JP) .

* cited by examiner

*Primary Examiner*—Corrine McDermott
*Assistant Examiner*—Chen-Wen Jiang
(74) *Attorney, Agent, or Firm*—Dykema, Gossett, PLLC

(57) ABSTRACT

A built-in box (1) for the feeding of inner units of air conditioning systems having a hollow element (2) substantially shaped as a parallelepiped, the hollow element having open base and the inside of the bottom (22) provided with a plurality of ribs (24). The built-in box (1) also has a small tank (3) for the drainage of the condensate, the tank (3) being positioned in correspondence with the open base of the hollow element (2) and being provided with at least a section of pipe (33) connecting it to the drain pipe (8) of the building main system. A substantially flat cover (4) can be fixed to the edge of the tank (3).

11 Claims, 3 Drawing Sheets

BOX FOR FEEDING OF INNER UNITS OF AIR-CONDITIONING SYSTEMS

BACKGROUND OF THE INVENTION

The present invention relates to a built-in box particulary suitable for facilitating the connection of the inner units of air-conditioning systems to the refrigerating pipes that feed the inner units themselves and to the condensate draining pipe.

At present, in the construction of residential buildings, the raceways for the air-conditioning system are carried out more and more frequently besides the raceways with chase for the traditional systems, like the electric and water supply systems.

The raceways comprise some built-in boxes that serve as terminal connection points for the air-conditioning units positioned inside the different rooms.

The built-in boxes used at present are manufactured through the moulding of thermoplastic material and do not differ from the standard boxes used also for other types of systems, like the connector blocks of the electrical systems, except for their dimensions, which must be suitable for those of the bracket to be used for the anchorage of the inner air-conditioning units.

Currently in the art, the built-in boxes for air-conditioning systems receive three pipes, two of which are the delivery and return pipes of the refrigerating unit, while the third one serves to drain the condensate water. The three pipes are built in the wall and they reach the box through holes made on the side or lower edges of the box itself.

A first drawback of the known boxes concerns the correct positioning and anchorage to the wall of the rear bracket with which each inner air-conditioning unit is provided. In fact, finding the ideal position of this bracket is not so simple as it may seem to the inexpert installer, since it requires considerable skill. This is also due to the fact that it is necessary to work in reduces spaces during the operations necessary for the connection of the inner units to the refrigerating pipes and to the condensate draining pipe, which are previously laid in chases.

However, the greatest risk involved in the incorrect positioning of the inner air-conditioning units is represented by the fact that siphon effects may involuntarily be produced in the draining pipe of the condensate that forms in each one of said air-conditioning units, thus comprimising their correct operation.

SUMMARY OF THE INVENTION

An object of the present invention is the implementation of a built-in box designed to be usefully employed for the installation of the inner units of air conditioning systems, thus facilitating the wall connection of the unit themselves.

Another object of the invention is the implementation of a box that facilitates the continuous draining of condensate, thus avoiding the risk of incorrect operation of the air conditioning units due to the above mentioned siphon effect.

The above mentioned goals have been achieved through the implementation of a built-in box for the feeding of the inner units of air-conditioning systems, which has a hollow element substantially shaped as a parallelepiped, the hollow element having an open base and the inside of the bottom provided with a plurality of ribs. The build-in box also has a small tank for the drainage of the condensate, the tank being positioned in correspondence with the open base of the hollow element and being provided with at a least a section of pipe connecting it to the appropriate draining pipe of the building main system. A substantially flat cover can be fixed to the edge of the tank.

According to a first embodiment of the invention, the built-in box is moulded in two distinct pieces, the first one of which constitutes the parallelepiped-shaped hollow element without base, while the second one constitutes the condensate drainage tank positioned in correspondence with said lower base and coupled to the hollow element.

In the second embodiment of the invention, the condensate drainage tank constitutes the lower part of a single moulded piece that makes up the entire box itself.

The goal s and advantages described above will be better highlighted in the description of the present invention as illustrated in the enclosed drawings.

DETAILED DESCRIPTION OF THE INVENTION

Figure 1:
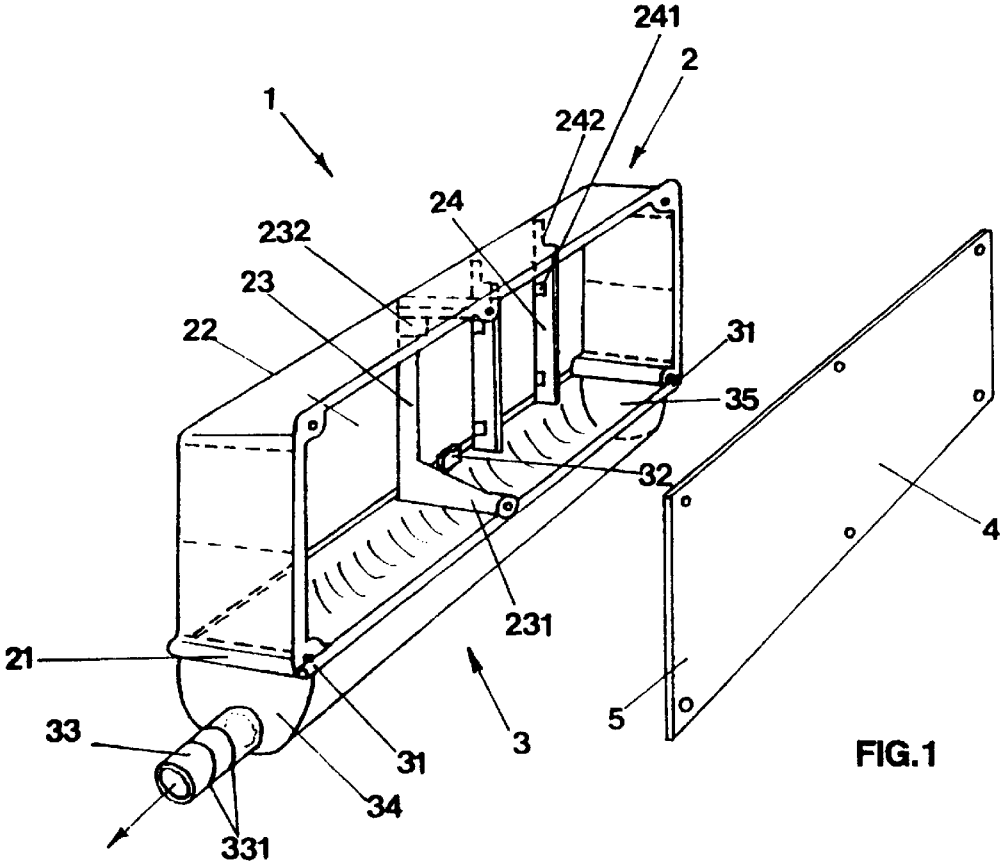
FIG. 1 is an exploded perspective view of the box of the present invention with the front closing cover separated from it.
Figure 2:
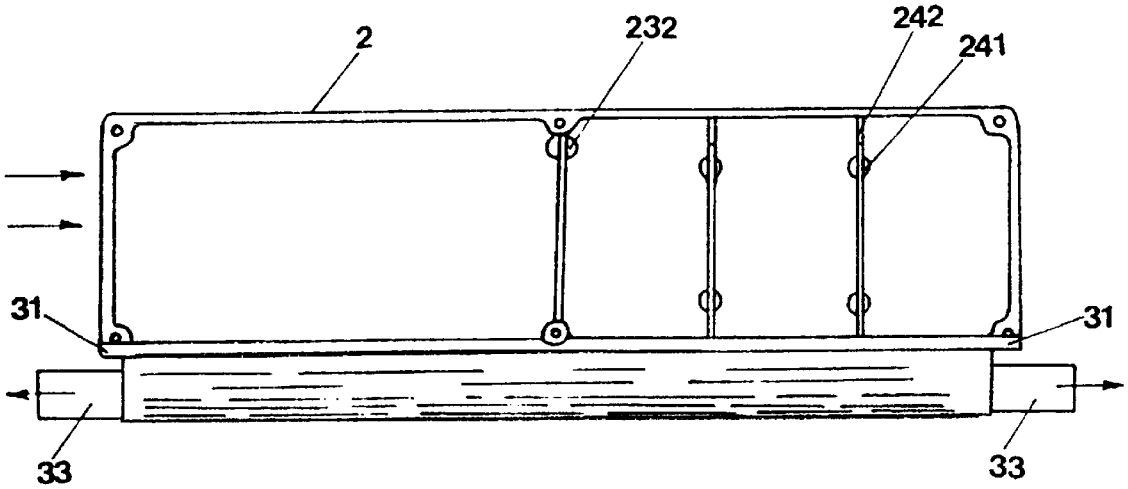
FIG. 2 is a front elevation view of the box with the cover removed therefrom.

As shown in FIGS. 1 and 2, the box 1 of the present invention, has a hollow element 2, which substantially has the shape of a parallelepiped without lower base. The semicylinderical tank 3 is positioned in correspondence with the lower base, the tank 3 being laterally anchored to the lower edges 21 of the sides of the hollow element 2 and being therefore in communication with the hollow element 2 itself.

The tank 3 is also coupled to the bottom 22 of the hollow element 2 through coupling means provided on the lower edge of the bottom itself and cooperating with the means 32 provided on the rear edge of the tank.

Figure 3:
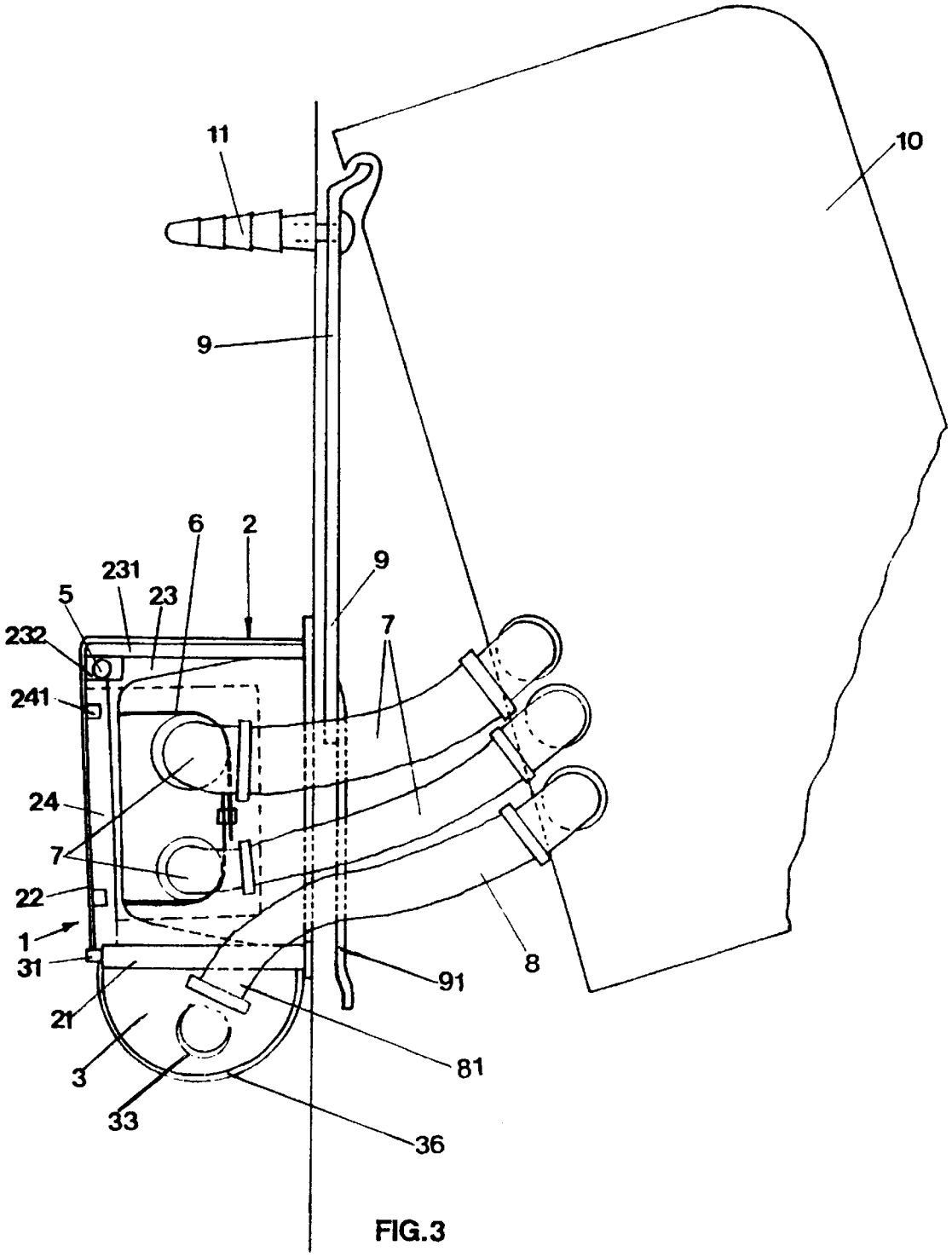
FIG. 3 is a side elevation view of the box built in a wall, with the coupling bracket of the air conditioning unit positioned over it.
Figure 4:
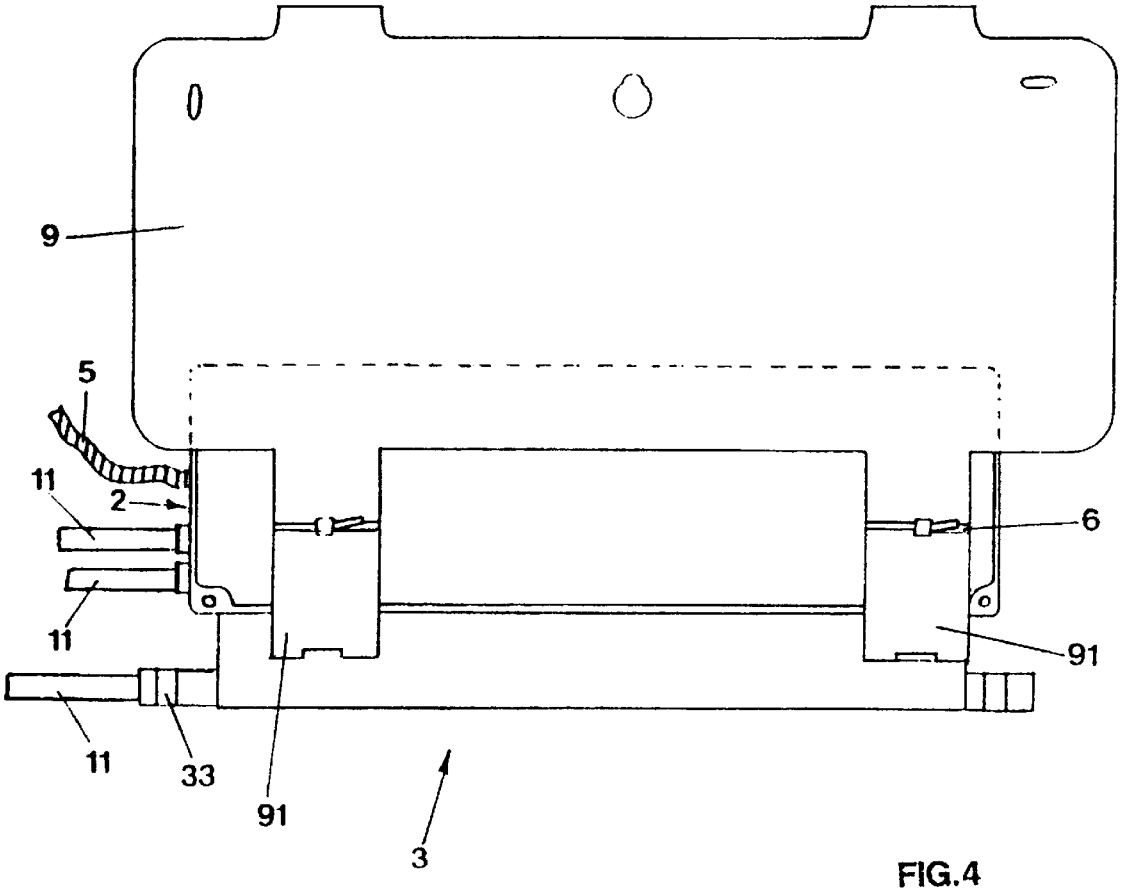
FIG. 4 is a front elevation view of the built-in box, showing the bracket supporting the air-conditioning unit.

The bottom 22 comprises a central rib 23 that stiffens the hollow element 2 and whose ends are provided with coupling elements 231 and self-threading screws for the fastening of the box cover 4 (FIG. 1) and with an opening 232 for the passage of the air conditioner electric cable 5 (FIGS. 3 and 4).

The same bottom 22 also has a plurality of other ribs 24 provided with transversal holes 241 to which it is possible to couple the locking clamps 6 (FIGS. 3 and 4) of the refrigerating pipes 7 and of the condensate draining pipe 8 and the bracket 9 of the air conditioner 10.

The ribs 24 are also provided, in their upper part, with seats 242 for the positioning of the electric cable 5 that crosses the box 1 as shown in of FIG. 4.

The tank 3 for the drainage of the condensate that continually forms during the operation of each unit of the air conditioning system is preferably carried out separately from the hollow element 2 and comprises the lateral coupling means 31 that can be inserted in the above mentioned shaped edges 21 of the hollow element and the rear coupling means 32.

The tank 3 comprises an element 33 for the connection to the condensate draining pipe 8 (FIG. 4). The element 33 will preferably have the shape of a pipe section positioned in correspondence with both the flat side surfaces 34 and 35 of the tank 3 itself and will be provided with seals 331.

The connection element 33 comprises a hole that is made blind by an interposed diaphragm 332 that can be easily broken through in order to ensure the drainage towards one of the tank sides, or to permit the communication on both sides if it is necessary to collect the condensate produced by more air conditioning units 10 connected in series and let it flow towards a single condensate draining pipe 8.

As shown, in FIGS. 3 and 4, the particular configuration of the box 1 of the indenting considerably simplifies the application of the air conditioning unit support bracket 9 to a wall 12 of the room to be provided with air conditioning and its correct positioning with respect to the box 1 previously built in the wall 11 itself. In fact, it is sufficient to use a single screw anchor 11 (FIG. 3), whose screw fastens the bracket 9 centrally, in the most suitable position in relation to the space necessary for the exit from the box 1 of the refrigerating pipes 7 to be connected to the corresponding pipes of the air conditioning unit 10.

The outlet (exit) can be positioned laterally (usually on the left, as shown in FIG. 4) with respect to the pair of protrusions 91 belonging to the bracket 9, or centrally with respect to the protrusions themselves. In any case, the anchorage of said protrusions 91 to the ribs 24 on the box bottom 22 by means of the clamps 6 is considerably facilitated. Also, the connection of the refrigerating pipes of the main system to the corresponding pipes 7 of the air conditioning unit 10 can be carried out more comfortably by the operator, since the bracket 9 is already fixed to the box 1 and the upper part of the air conditioning unit 10 is coupled to the bracket 9 (FIG. 3), while its lower part is sufficiently detached from the wall 12 to make it possible to carry out the operations described above.

As shown in FIG. 3, the condensate draining pipe 8 belonging to the air conditioning unit 10 is always positioned below the refrigerating pipes 7. The operator simply has to lay its open end 81 on the bottom 36 of the tank 3, which will thus serve as a connection element to the fixed drain pipe 8 previously laid in a chase together with the box 1.

Since the position of the tank 3 is, in any case, lower than the inlet of the refrigerating pipes 7 in the built-in box 1, the siphon effect described above will certainly be avoided, which is the greatest advantage offered by the box 1 of the present invention.

A further advantage of the box 1 of this invention is that the condensate drainage tank can serve as a through element in the series connection of several inner air conditioning units 10 to a single final draining pipe 8. It is also important to point out that the box 1 has two opposite connection elements 33 for the drainage of the condensate and that since each connection element 33 is originally provided with a diaphragm 332, it is possible to select the element to be connected to the drain unit according to the built-in system already arranged on the right or on the left of the box 1.

The above description clearly demonstrates that the box 1 of the present invention actually achieves the set goals. Obviously, the combination of the two pieces making up the box 1 and their mutual coupling means can differ from those described above, like the shapes and dimensions of some components of these pieces themselves.

It is also obvious that the same advantages can be achieved also with a box 1 carried out in a single piece, having in any case the front access opening higher than the base, which will be shaped as a tank 3 for the collection and drainage of the condensate towards the appropriate pipe. Any variant of the box 1 of this invention is therefore to be considered as protected by the present invention.

What is claimed is:

1. A box for the feeding of inner units of air conditioning systems comprising:

a hollow element having a plurality of walls, an open base and an open edge;

a tank for draining condensate from an air conditioner, said tank connected to said open base of said hollow element;

at least one pipe for draining condensate from said tank, said at least one pipe connected to said tank;

a diaphragm located within said at least one pipe, said diaphragm capable of being broken to allow for drainage of condensate through said at least one pipe;

a cover for connecting to said open edge of said hollow element.

2. The box of claim 1, further comprising:

a plurality of ribs within said hollow element for stiffening said hollow element and to facilitate coupling said at least one pipe to said hollow element.

3. The box of claim 2, wherein a portion of said plurality of ribs each have a seat therein for housing a cable of an air conditioning unit.

4. The box of claim 3, further comprising lateral coupling means and rear coupling means for connecting said hollow element to said tank.

5. The box of claim 4, wherein said tank is substantially semicylindrical.

6. A built-in box for the feeding of the inner units of air-conditioning systems, comprising:

a hollow element substantially shaped as a parallelepiped, said hollow element having an open base and the inside of the bottom provided with a plurality of ribs;

a small tank for the drainage of condensate, said tank being positioned in correspondence with said open base of said hollow element and being provided with at least a section of pipe connecting it to a drain pipe of the building main system; and a substantially flat cover for connecting to the edge of said hollow element.

7. The built-in box according to claim 6, wherein said tank is provided with two opposite pipe sections for connection with the drain pipe, each section being provided with a diaphragm suitable for being broken through in order to permit the drainage of the condensate in said drain pipe.

8. The built-in box according to claim 6, wherein said plurality of ribs are provided with transversal holes for housing flexible anchorage means.

9. The built-in box according to claim 6, wherein each one of said ribs is provided with a seat on an upper part thereof, said seats being aligned according to a substantially horizontal line and for housing an electric cable of an air-conditioning unit.

10. The built-in box according to claim 6, wherein said hollow element and said tank are separate elements and comprise lateral coupling means and rear coupling means for connecting said hollow element to said tank.

11. The built in box according to claim 6, wherein said tank is substantially semicylindrical.

* * * * *